United States Patent [19]

Welch et al.

[11] Patent Number: 4,547,113

[45] Date of Patent: Oct. 15, 1985

[54] CONTINUOUS MOTION SPIRAL STACKER

[75] Inventors: David P. Welch, Cincinnati; David R. Bennett, Fairfield, both of Ohio

[73] Assignee: The Procter & Gamble Company, Cincinnati, Ohio

[21] Appl. No.: 622,216

[22] Filed: Jun. 19, 1984

[51] Int. Cl.[4] ..... B65H 31/10; B65H 31/30

[52] U.S. Cl. ..... 414/49; 198/422; 198/424; 271/217; 414/50; 414/69; 414/98; 414/786

[58] Field of Search ..... 414/43, 48, 49, 50, 414/69, 81, 93, 97, 98, 786; 271/118, 217, 218; 198/422, 424

[56] References Cited

U.S. PATENT DOCUMENTS

| | | | |
|---|---|---|---|
| 2,556,214 | 6/1951 | Pottle | 414/47 |
| 2,954,133 | 9/1960 | Geisow | 414/93 |
| 3,122,230 | 2/1964 | Bogue | 414/69 |
| 3,280,679 | 10/1966 | Huffman | 414/49 X |
| 3,831,781 | 8/1974 | Anikanov et al. | 414/93 |
| 3,871,539 | 3/1975 | Nikkel | 414/43 X |

FOREIGN PATENT DOCUMENTS

| | | | |
|---|---|---|---|
| 1597548 | 9/1981 | United Kingdom | 198/422 |

*Primary Examiner*—Leslie J. Paperner

*Attorney, Agent, or Firm*—Frost & Jacobs

[57] ABSTRACT

Apparatus and method for accumulating generally flat articles of substantially the same size and shape into stacks of specific count. The apparatus comprises at least one vertically oriented spiral member having an exterior leading edge and an interior trailing edge. A prime mover rotates the spiral member about its horizontal axis of rotation. A product stack-building area is provided through which the leading and trailing edges of the spiral member passes once each revolution thereof. An infeed device feeds products at substantially the same elevation to the top of the stack-building area and onto the outer surface of the spiral member constituting a product support surface which recedes from the article infeed elevation at a predetermined rate. At least one side plate is provided to keep the products within the stack-building area. An outfeed device to receive stacked products passes through the spiral member at an elevation just below the trailing edge thereof. Products are fed to the top of the stack-building area. The spiral element is rotated through the stack-building area, and as its leading edge passes therethrough, a new product stack is started thereon and is segregated from the previous stack accumulated on the spiral member. The previous accumulated stack is deposited on the outfeed device by the trailing edge of the spiral member.

31 Claims, 11 Drawing Figures

CONTINUOUS MOTION SPIRAL STACKER

TECHNICAL FIELD

The present invention relates to apparatus and a method for accumulating generally flat products of substantially the same size and shape into stacks of specific count at high speed, and more particularly to such apparatus and method utilizing a spiral assembly upon which individual products are deposited and accumulated into stacks, and from which the stacks are discharged.

BACKGROUND ART

Prior art workers have devised numerous types of conveyors and stackers utilizing spiral elements or rotating screws having helical threads. For example, U.S. Pat. No. 2,556,214, issued in the name of R. K. Pottle on June 12, 1951, teaches a machine for counting, stacking and packing sheet can ends. The machine employs a rotating cut-off knife, having a spiral groove to separate a predetermined number of can ends from a magazine thereof, so that they can be ultimately fed to cylindrical packing tubes. U.S. Pat. No. 2,954,133, issued to J. C. H. Geisow on Sept. 29, 1960, describes a reversible stacking and unstacking mechanism. The mechanism employs a pair of mirror image cams having spiral edge portions for separating and feeding flat articles.

Commonly-owned co-pending application Ser. No. 428,319, in the names of Howard N. Watrous, Walter Cash, Jr. and Weldon R. Dixon, filed Sept. 29, 1982, and entitled "POSITIVE CONTROL STACKER", teaches a high speed stacker for rigid and semi-rigid sheet or pad-like products utilizing one or more cooperating pairs of screws having properly configured spiral or helical threads. The screw pairs are utilized to form product stacks of specific count, with the products of each stack being aligned. One or more pairs of continuously rotating single-thread screws can be utilized in conjunction with the one or more pairs of stacker screws either to simply convey the stacks formed by the stacker screws, or to accumulate and convey the stacker screw stacks, depending upon the rotational speed of the single-thread screws, relative to the stacker screws.

Numerous other types of stacking devices have been developed. These devices depend on intermittent motion to identify and segregate product stacks. Stackers of this general type are inherently slow and are usually characterized by complex construction.

The present invention is based upon the discovery that numerous advantages can be achieved by employing a simple spiral assembly as a stacking element, the spiral assembly preferably being vertically oriented with its axis of rotation horizontally oriented and being rotated at a constant speed about its axis. The spiral assembly comprises a single spiral element or a pair of spaced mirror image spiral elements having an exterior leading edge, an interior trailing edge, and an exterior product supporting surface. The leading edge of the spiral assembly passes through a stack-building area and individual products are deposited on the exterior surface of the spiral element, one on top of the other. Means are provided to maintain the products stationary within the stack-building area as the exterior surface of the spiral assembly passes therethrough. At the end of a complete revolution of the spiral assembly, the leading edge thereof again passes through the stack building area to begin a new stack and segregate the new stack from the previously accumulated stack. Meanwhile, the trailing edge of the spiral assembly slips out from under the previously accumulated product stack, depositing it on an outfeed device passing through the spiral assembly.

The spiral stacker of the present invention forms product stacks of specific count. The spiral assembly, its supports, and the means imparting rotating to it are the only moving parts of the device.

The spiral stacker of the present invention is characterized by unusually simple mechanical construction. Since the spiral stacker utilizes continuous rotary motion, it has an inherently higher speed potential than devices depending upon intermittent motion to identify and segregate a product stack. The device may be used for a wide range of products ranging from thin, flat products to thick, semi-flat products of the same general size and shape. While not so limited, the high proportion of peripheral motion to stack motion renders the spiral stacker ideally suited for thin products.

DISCLOSURE OF THE INVENTION

According to the invention, there is provided both apparatus and a method for accumulating generally flat articles of substantially the same size and shape into stacks of specific count. The apparatus comprises, in the preferred embodiment, a pair of vertically oriented, mirror image spiral members in parallel spaced relationship. Each spiral member has an exterior leading edge and an interior trailing edge. A prime mover rotates the spiral members about their coaxial axes in phase.

A product stack-building area is provided. The outer surfaces of the spiral members from their leading edges to the trailing edges constitute article support surfaces. The leading edges of the spiral members pass through the stack-building area simultaneously, and their trailing edges exit the stack-building area simultaneously. An infeed device feeds products at substantially the same elevation to the top of the stack-building area. The article support surfaces of the spiral members recede from the article infeed elevation at a substantially constant rate so that the products accumulate one above the other in stacked form. At least one plate is provided between the spiral members to maintain the products within the stack-building area and stationary relative to the constantly moving support surfaces of the spiral members. An outfeed device passes through the spiral members to receive the accumulated product stacks.

According to the method of the present invention, at least one spiral member, preferably having a horizontally oriented axis of rotation, is rotated at a constant speed about its axis, and has an exterior leading edge, an interior trailing edge, and a product support surface extending therebetween. A stack-building area is provided through which the leading edge, the product support surface and the trailing edge of the at least one spiral member passes. Products are fed into the top of the stack-building area at substantialy the same elevation the products are maintained within the stack-building area so that a stack thereof accumulates on the product support surface of the at least one spiral member. As the leading edge of the at least one spiral member passes through the stack-building area, a new product stack is started on the product support surface and is isolated from the previously accumulated stack. Meanwhile, the previously accumulated stack is removed from the product support surface of the at least one spiral member as its trailing edge passes through the stack-building area. The stack is conducted away from the at least one spiral member in a direction substantially parallel to the axis thereof.

DETAILED DISCLOSURE OF THE INVENTION

The products stacked by the spiral stacker of the present invention do not constitute a limitation thereon. As indicated above, the products may be relatively thin or thick and may range from flat to semi-flat. The products should be of approximately the same size and shape. While not so limited, the device is particularly well adapted to the stacking of sheet or pad-like products.

The spiral stacker preferably comprises three basic elements: (a) a stack building area that arranges the products on top of each other; (b) at least one spiral element that establishes count in each stack and physically separates each stack upon completion; and (c) an output section that removes completed stacks from the at least one spiral element to any subsequent operation.

The products are fed to the spiral stacker of the present invention one at a time by an appropriate infeed mechanism. The nature of the infeed mechanism does not constitute a limitation of the present invention. The individual products fed to the spiral stacker could, themselves, each be stacks of individual products. Thus, the positive control stacker taught in the above noted commonly-owned co-pending application could serve as an infeed mechanism for the spiral stacker of the present invention. If the spiral stacker of the present invention is part of a manufacturing line for sheet or padlike products, the products could be cut by a cutter from a continuous strip thereof and conveyed from the cutter to a reject point by a first conveyor and from the reject point to the spiral stacker of the present invention by a second conveyor. It will evident from the above that the infeed mechanism may take many forms so long as it properly feeds the products to the spiral stacker one-by-one.

Figure 1:
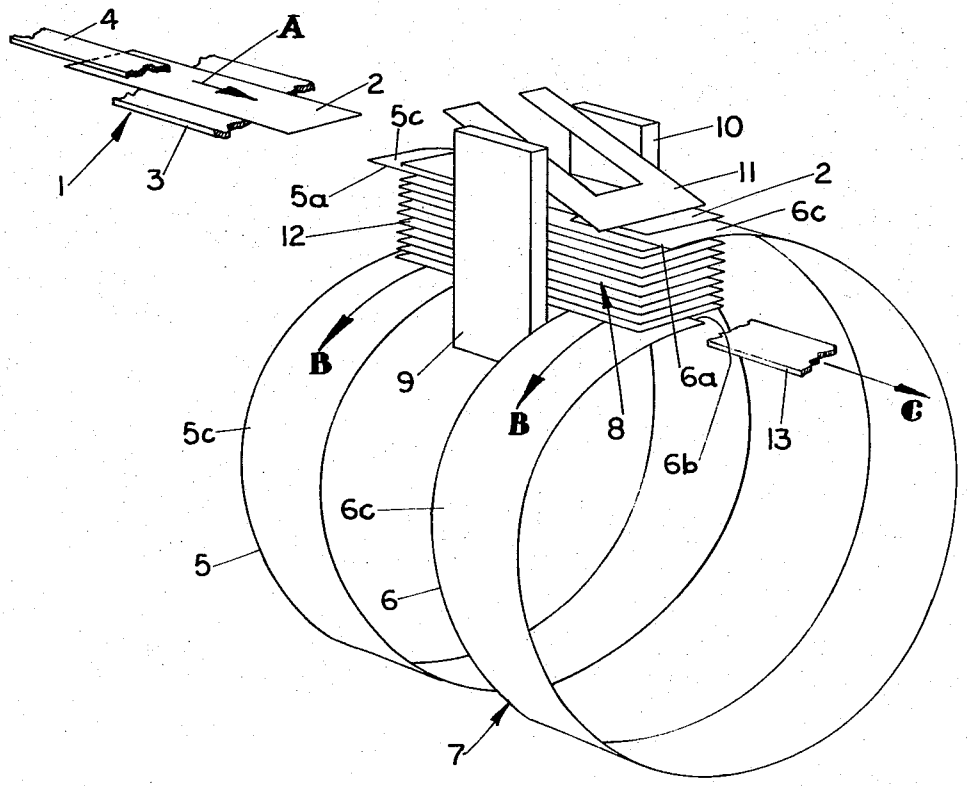
FIG. 1 is a perspective diagrammatic representation of the preferred embodiment of the present invention.
Figure 2:
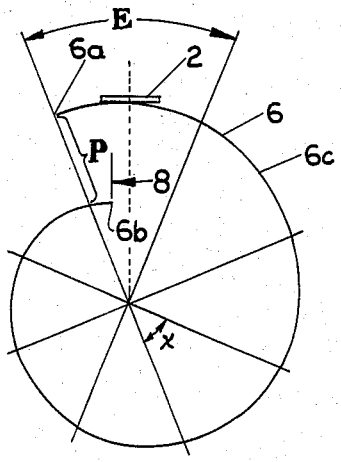
FIGS. 2–5 are diagrammatic representations of the spiral assembly of FIG. 1, illustrating a product stack being accumulated thereon.
Figure 3:
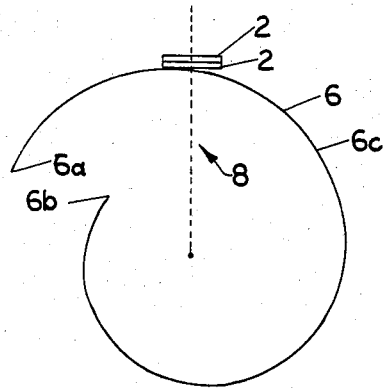

Turning to FIG. 1, an exemplary infeed mechanism is generally indicated at 1. An individual sheet-like product is shown at 2. The product is moved in the direction of arrow A by an underlying infeed belt 3 and an overlying drive belt 4.

In this example, products 2 are fed between belts 3 and 4 into a plow 11, forming a stack 12 of products on top of each other.

A stack-building area is generally indicated at 8 and is defined by a substantially vertical side plate 9 located between spiral elements 5 and 6. The side plate 9 restrains the products from following the product support surfaces 5*c* and 6*c* of spiral elements 5 and 6 as they rotate. The surface friction of the side plate 9, as is true of the product support surfaces 5*c* and 6*c*, should be very low. A second side plate 10, similar to side plate 9, can be provided to prevent a stack of products from toppling over backwards. Side plates 9 and 10 may be located at a slight angle to the vertical to reduce the tendency of a product stack to topple. Side plates 9 and 10 should be firmly and rigidly mounted, but preferably by means enabling their quick and easy removal for clearing jams and the like. In some applications the side plate(s) might be replaced by moving belts, according to the requirements being stacked, the downward motion of the belt being about the same as the downward motion of an individual product through the stack building area 8. To keep the products stable on the spiral element support surfaces 5*c* and 6*c* and to prevent cocking of the product stack due to differential friction with respect to the product support surfaces 5*c* and 6*c*, side plates 9 and 10 should be as wide as possible while maintaining a small running clearance with spiral elements 5 and 6. For example, the side plates should have a width equal to at least half the length of the products.

A pair of identical spiral elements 5 and 6 are provided and constitute the spiral assembly generally indicated at 7. The spiral elements have aligned leading edges 5*a* and 6*a*, aligned trailing edges, one of which is shown at 6*b*, and exterior product support surfaces 5*c* and 6*c* extending between their respective leading and trailing edges.

The axes of rotation (not shown), of vertically oriented spiral elements 5 and 6, are coaxial and horizontally oriented. Means (not shown) are provided to rotate the spiral elements 5 and 6 about their axes and in phase (i.e. with their leading and trailing edges aligned). In a particularly preferred embodiment, the spiral elements 5 and 6 are rotated continuously at constant speed.

The spiral elements 5 and 6 may be joined together in a squirrel cage fashion, or they may be wholly separate, individually supported with means to maintain them in phase, as will be described hereinafter. Preferably, the spiral elements should be adjustable toward and away from each other to accommodate different product lengths.

It is preferred that the axis of rotation of spiral elements 5 and 6 be horizontal since this orientation allows gravity to aid in stack formation and movement. Other orientations employing other than gravity can be used.

The infeed device 1, appropriately timed with the rotation of spiral elements 5 and 6, feeds the products 2 one at a time onto the spiral element product support surfaces 5*c* and 6*c*, the products being guided in place thereon by the plow 11.

As the spiral elements 5 and 6 rotate, infeed device 1 continues to deposit products near the top of stack-building area 8 and a stack 12 of products 2 is accumulated. The stack 12 is deposited by the spiral element trailing edges (one of which is shown at (6*b*) onto an outfeed device 13 passing through the spiral elements 5 and 6 in a substantially axial direction.

As will be evident from FIG. 1, the leading edges 5*a* and 6*a* of spiral elements 5 and 6, their entire supporting surfaces 5*c* and 6*c* and their trailing edges (one of which is shown at 6*b*) pass through the stack-building area 8 during each complete revolution of the spiral elements 5 and 6.

For a better understanding of the operation of the structure thus far described, reference is made to FIGS. 2–5. In these Figures, spiral element 6 is shown, it being understood that spiral element 5 is substantially identical and operates in an identical manner. The pitch P of the spiral element 6 should be at least equal to the height of a product stack, plus a convenient clearance distance D. In FIGS. 2–5, the pitch P, the clearance distance D (FIG. 4) and the product thickness have been greatly exaggerated for purposes of clarity. The spiral defined by spiral element 6 is essentially a linear spiral. Some adjustment at its leading edge 6*a* and trailing edge 6*b* may need to be made for purposes of clearance and the like. It will be understood that the distance E should be larger than the width of a product. Since one complete stack is produced during each revolution of spiral element 6, the angle X constitutes the number of degrees each product is allocated. Thus, the angle X equals 360° divided by N, where N is equal to the stack count. Thus, if N equals 8, X equals 45°. If N equals 30, X equals 12°, and so on. For purposes of an exemplary showing, FIGS. 2–5 illustrate the building of a stack 12 having a stack count N of 8.

The design of the support surface 6*c* is such that the bottom of the stack falls away at about the same rate products are added to the top of the stack. This arrangement maintains the top of the stack approximately at the same elevation (see FIGS. 2 and 3), permitting a relatively uniform infeed process. The infeed device 1 is preferably set to feed a new product 2 at predetermined equal fractional parts of the full revolution of spiral element 6. Thus, when N equals 8, the infeed device 1 will deposit a product, either directly on product support surface 6*c* of spiral element 6 or on top of the previously deposited product, every eighth of a revolution of spiral element 6. It will be understood that between the position of spiral element 6 shown in FIG. 3 and its position shown in FIG. 4, it will have turned nearly three quarters of a turn and six additional products 2 will have been added to the stack 12 to make a full stack count.

Figure 4:
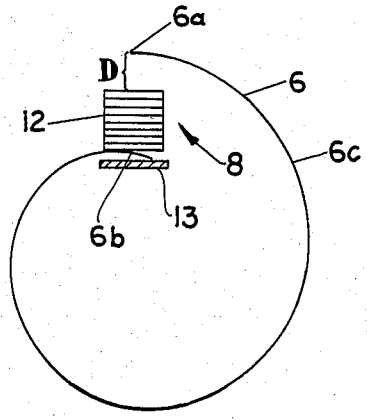
Figure 5:
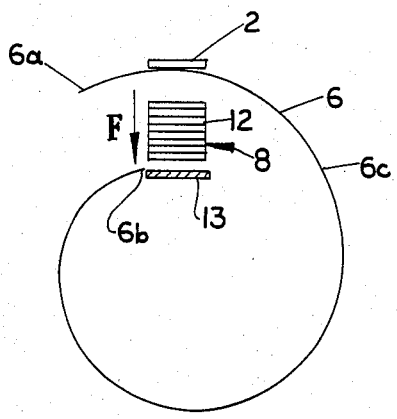

In FIG. 4, the leading edge 6*a* of spiral element 6 is beginning to pass through the stack-building area 8 again. As will be evident from FIGS. 4 and 5, this accomplishes two purposes. First, a new stack is begun on product support surface 6*c*, as shown in FIG. 5. Second, the new stack is physically segregated from completed stack 12. Third, the completed stack 12 consists of those products fed into the stack building area 8 since the last time the leading edge 6*a* passed through the stack building area 8. Consequently the stack count is established by the number of products fed into the stack building area in exactly one revolution of the leading edge 6*a* of spiral 6. This aspect makes the invention well suited for forming stacks of product to exact count.

The function of the output section is to remove a completed stack from the spiral surfaces to any subsequent operation. At some convenient time after the stack is completed, the trailing edge 6*b* of spiral element 6 passes through stack-building area 8 in FIG. 4. Once it passes through the stack-building area 8, the trailing edge 6*b* will deposit completed stack 12 on outfeed device 13. The trailing edge 6*b* of spiral element 6 sweeps out a clearance radius which should be large enough to clear the outfeed device 13 which passes through the clearance diameter and to have a sufficient velocity for a clean drop of the stack 12 onto the outfeed device 13.

The total arc between leading edge 6*a* and the trailing edge 6*b* should be at least one 360° revolution to support the stack in the stack-building area. The trailing edge 6*b* can be extended any convenient distance to facilitate the output section as illustrated in the two examples shown in FIGS. 10 and 11. Spirals 106 and 206 shown in FIGS. 10 and 11, respectively, are generally similar to spiral 6 with the exception of the radial positioning of their trailing edges.

Figure 10:
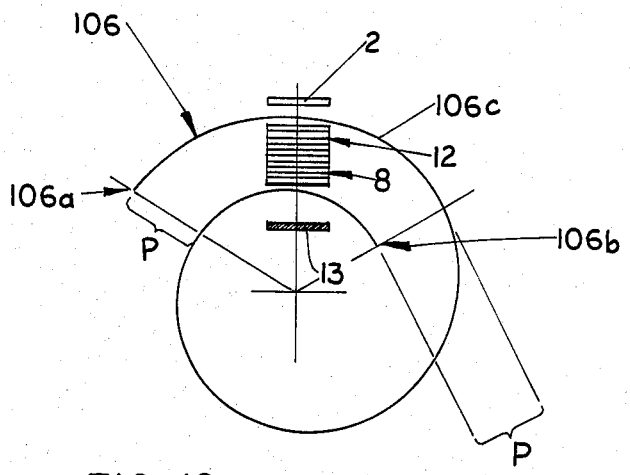
FIGS. 10 and 11 are diagrammatic representations of alternative spiral assemblies of the type generally disclosed in FIG. 1.

In the example shown in FIG. 10, trailing edge 106*b* of spiral 106 is extended at the same helix angle as shown in the main spiral 106, thereby maintaining the same clearance "P" at the trailing edge 106*b* as at the leading edge 106*a*.

Figure 11:
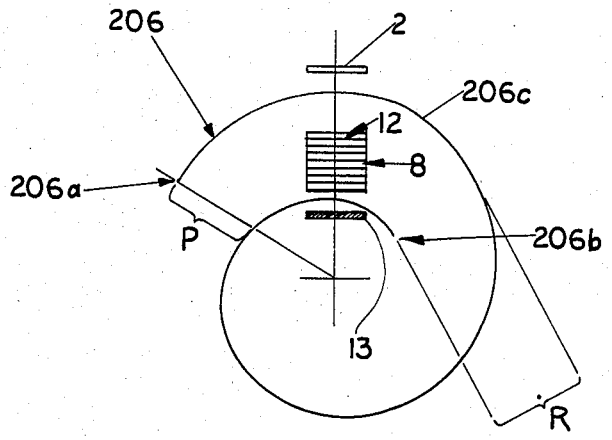

In the example shown in FIG. 11, trailing edge 206*b* is extended at a steeper helix angle than the main spiral 206, thereby creating a larger clearance "R" at the trailing edge 206*b* than the clearance "P" at the leading edge 206*a*.

The larger clearance "R" in the example of FIG. 11 provides additional time to remove the stack 12, permitting a slower, smoother motion of the output device that is useful in some applications of the invention.

As in the case of the infeed device 1, the outfeed device 13 can take any appropriate form. It could, for example, constitute a pair of parallel spaced guide rails having a roller chain or the like thereunder provided with upstanding fingers adapted to engage and push the trailing end of each stack, advancing each stack to the next stage in the process. The processing steps following the spiral stacker do not constitute a part of the invention. For purposes of an exemplary showing, the outfeed device 13 is illustrated as being a simple conveyor belt. The belt travels in the direction of arrow C. The direction C is substantially axial with respect to the axes of rotation of spiral elements 5 and 6.

Figure 6:
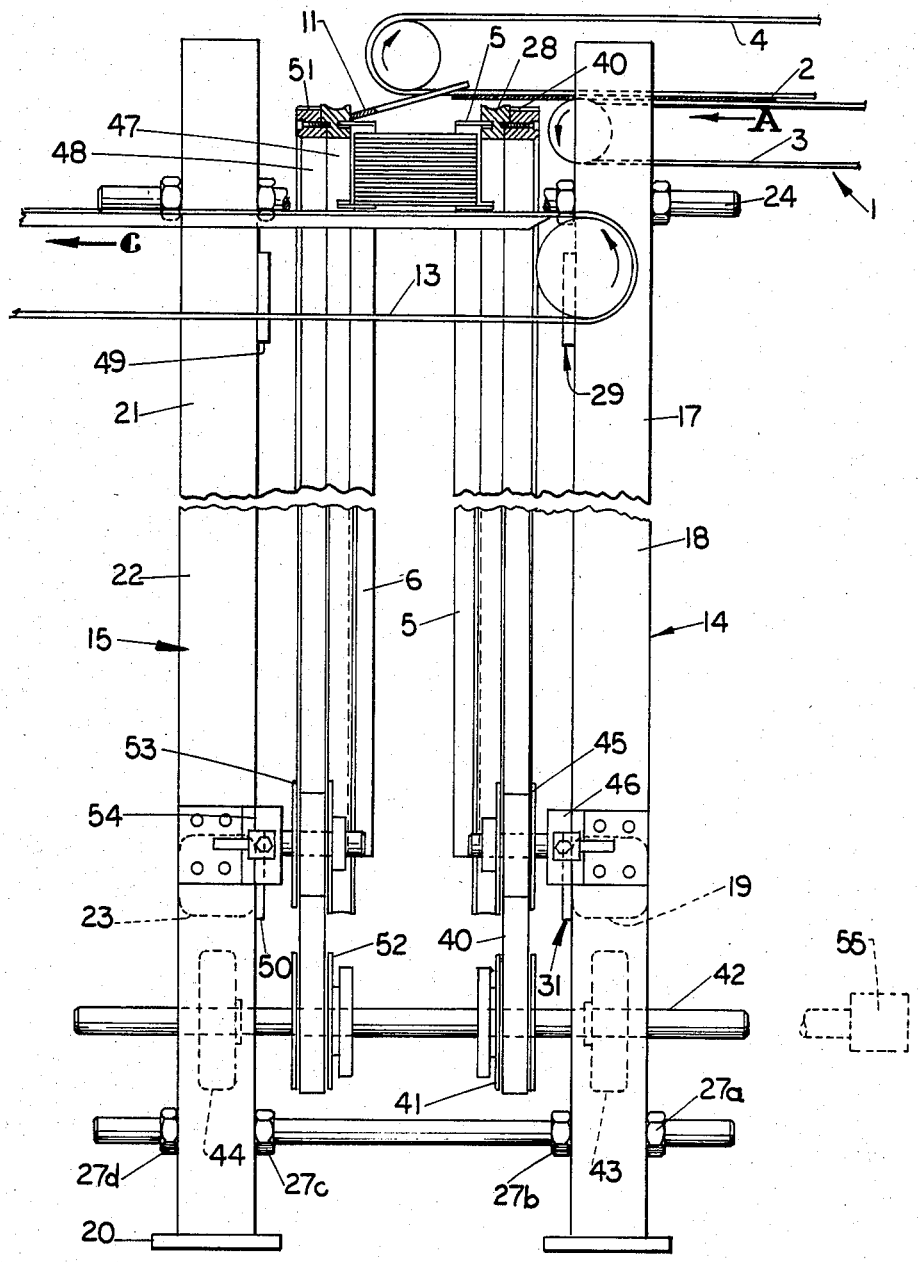
FIG. 6 is an elevational view, partly in cross section, of a working embodiment of the spiral stacker of FIG. 1.
Figure 7:
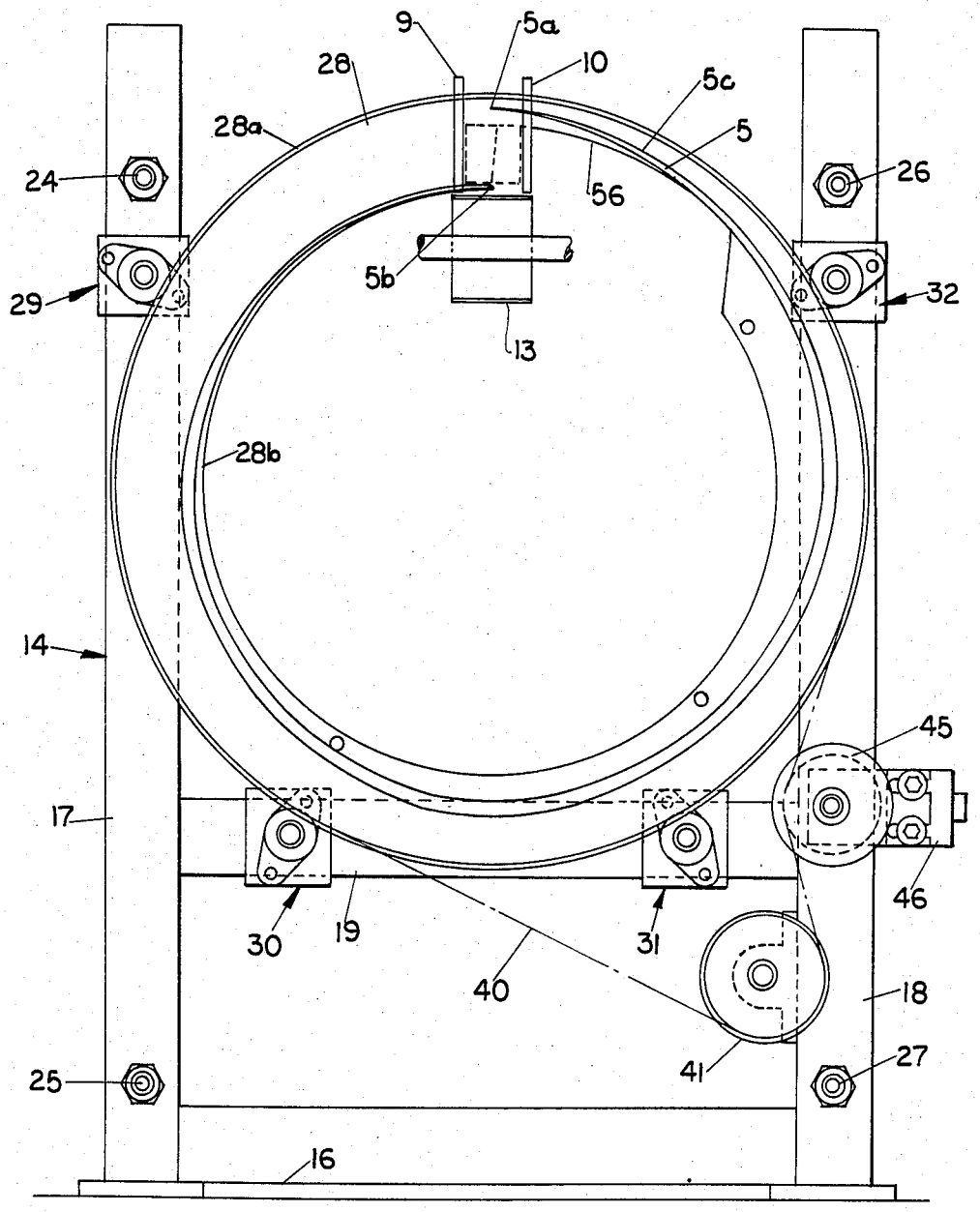
FIG. 7 is a cross-sectional elevational view taken along the vertical center line of the spiral stacker of FIG. 6, illustrating the right hand side frame and spiral element, as viewed in FIG. 6.

Reference is made to FIGS. 6 and 7, wherein a working embodiment of the spiral stacker of FIG. 1 is illustrated. Where possible, like parts have been given like index numerals. The spiral stacker comprises two side frame members generally indicated at 14 and 15 in FIG. 6. Side frame member 14 is not clearly shown in FIG. 7. Side frame member 14 comprises a base 16 upon which two upright frame members 17 and 18 are mounted. The upright frame members 17 and 18 are joined together by a horizontal frame member 19. Side frame 15 is substantially a mirror image of side frame 14 (see FIG. 6) and comprises a base member 20, a pair of uprights 21 and 22 equivalent to uprights 17 and 18. The uprights 21 and 22 are joined together by a horizontal member 23, equivalent to horizontal member 19.

The uprights 27 and 18 of side frame 14 are joined to uprights 21 and 22, respectively, of side frame 15 by horizontally oriented threaded rods 24, 25, 26 and 27. Threaded rod 27 is clearly shown at the lower end of FIG. 6. Threaded rod 27 passes through coaxial perforations in upright 18 of side frame 14 and upright 22 of side frame 15. The threaded rod 27 is provided with a pair of nuts 27*a* and 27*b* to either side of upright 18 and a pair of nuts 27*c* and 27*d* to either side of upright 22. When the uprights 18 and 22 are properly spaced from each other, the pairs of nuts are tighened against their adjacent upright to lock the members in place. It will be understood that threaded rods 24, 25 and 26 pass through coaxial perforations in their respective uprights in a similar fashion, being provided with pairs of nuts lying to either side of their respective uprights. By virtue of this construction, the side frames 14 and 15 of the spiral stacker can be shifted toward and away from each other. This enables the spiral elements 5 and 6 to be shifted toward and away from each other to accommodate products of different lengths. The spiral element 5 is illustrated in FIG. 7, together with its leading edge 5*a*, its trailing edge 5*b* and its product supporting surface 5*c*. The spiral element 5 is removably mounted in an appropriately shaped groove in a circular side plate 28. The side plate 28 has a circular outer peripheral edge 28*a* having a diameter slightly greater than the diameter of the circle swept by the leading edge 5*a* of spiral element 5. Side plate 28 similarly has a circular peripheral inner edge 28*b* having a diameter slightly less than the diameter of the circle swept by the trailing edge 5*b* of spiral element 5.

Figure 8:
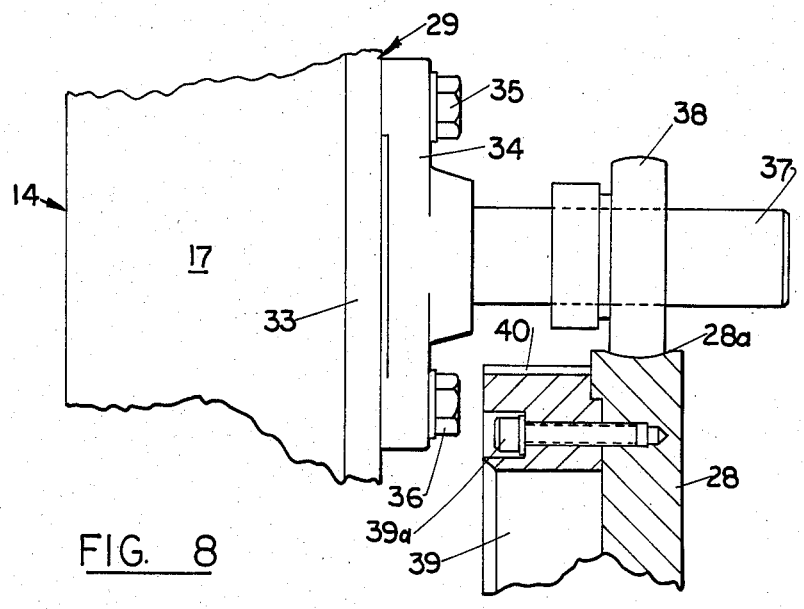
FIG. 8 is a fragmentary elevational view of a typical bearing support for the spiral elements of FIGS. 6 and 7.

The circular side plate 28 and spiral element 5 are rotatively mounted on side frame 14 by four substantially identical bearing means generally indicated at 29, 30, 31 and 32. Bearing means 29 is mounted at the upper end of upright 17. Bearing means 30 and 31 are mounted on horizontal side frame member 19, while bearing means 32 is mounted at the upper end of side frame upright 18. Since the bearing means 29–32 are substantially identical, a description of bearing means 29 will stand for all of them. The bearing means 29 is illustrated in FIG. 8. Bearing means 29 comprises a base plate 33 welded or otherwise appropriately affixed to side frame upright member 17. A bracket 34 is affixed to base plate 33 by bolts 35 and 36. The bracket 34 supports a stub shaft 37. A spherical bearing 38 is rotatively mounted on shaft 37. It will be noted that the peripheral outer edge 28*a* of side plate 28 is concave and is engaged by the spherical bearing 38. The concave edge 28*a* of circular side plate 28 is similarly engaged by all of the bearing assemblies 30, 31 and 32, as well. As a result of this, the circular side plate 28 and spiral element 5 are rotatively mounted with respect to side frame 14.

As is clearly shown in FIGS. 6 and 8, a large circular pulley 39 is affixed by bolts 39*a* to that side of circular side plate 28 opposite the spiral element 5. The pulley 39 is engaged by a timing belt 40 which also engages a sprocket or pulley 41. The sprocket 41 is mounted on a shaft 42 which, in turn, is mounted in bearings 43 and 44, attached to uprights 18 and 22, respectively. An additional pulley 45 is mounted on adjustable bracket 46, in turn mounted on side frame vertical member 18. Pulley 45 serves as a tightener for timing belt 40.

Spiral element 6 is removably mounted to a circular side plate 47, constituting a mirror image of circular side plate 28. Similarly, a circular pulley 48 is affixed to the circular side plate 47. The circular side plate 47 is rotatively mounted on side frame 15 by bearing means identical to bearing means 29–32 of FIG. 7. The bearing means 29–32 are not shown in FIG. 6 except for the base plates of bearing means 29 and 31. The same is true for the bearing means of circular side plate 47, a base plate for two of the four bearing means being shown in FIG. 6 at 49 and 50. The pulley 48 is engaged by a timing belt 51, identical to timing belt 40. The timing belt 51 passes about a pulley or sprocket 52 mounted on shaft 42. A pulley 53 is mounted on an adjustable bracket 54. This assembly is equivalent to pulley 45 and bracket 46 and serves as a tightener for timing belt 51.

The shaft 42 is operatively connected to an appropriate prime mover diagrammatically indicated in FIG. 6 by a broken rectangle 55. Thus, spiral element 5, side plate 28 and pulley 40, forming one spiral assembly, and spiral element 6, side plate 47 and pulley 48 forming the other spiral assembly are both run by timing belts from shaft 42 by the same prime mover. As a result of this, the spiral assemblies rotate together and in phase (as though they were joined together), with the leading edges and the trailing edges of spirals 5 and 6 being aligned.

Returning to FIG. 6, the infeed device 1 is shown, including infeed belt 3, overhead drive belt 4 and a product 2 therebetween. The plow 11 is also illustrated in FIG. 6. For purposes of clarity, side plates 9 and 10 have been eliminated from FIG. 6. However, they are shown in FIG. 7.

Outfeed belt 13 is shown in both FIGS. 6 and 7.

It will be noted in FIG. 7 that circular side plate 28 has a large notch or cut-out portion 56 formed therein. It will be understood that circular side plate 47 will have a similar cut-out. These cut-outs enable conveyor 13 to remove a stack from the spiral stacker. In the embodiment shown, such a cut-out is really needed only in side plate 47. However, identical cut-outs are provided in both side plates so that the structures are balanced. Furthermore, this enables the outfeed conveyor to be run in either direction.

It will be understood by one skilled in the art that the spiral stacker described with respect to FIGS. 6, 7 and 8 operates in a manner identical to that disclosed with respect to FIGS. 1–5.

Figure 9:
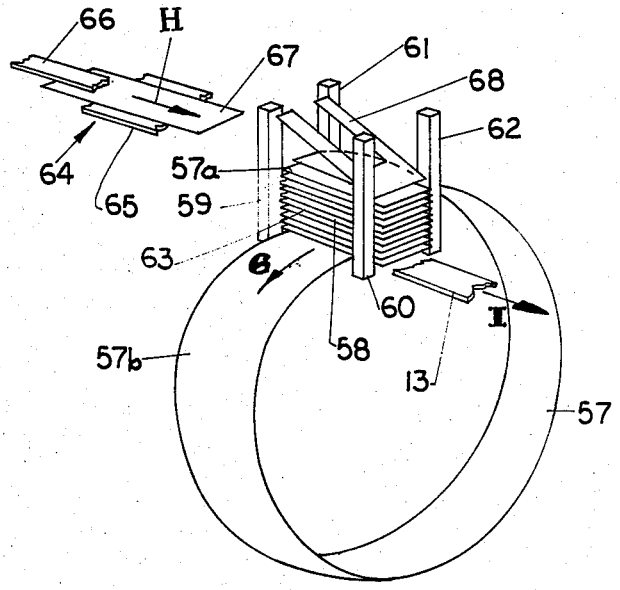
FIG. 9 is a perspective diagrammatic view, similar to FIG. 1, and illustrating an embodiment of the spiral stacker utilizing a single spiral element.

FIG. 9 illustrates a second embodiment of the present invention utilizing a single spiral member 57. The spiral member 57 is the full equivalent of either of the spiral members 5 and 6 of FIG. 1, is vertically oriented and is capable of rotation in the direction of arrow G about its axis of rotation, which is horizontally oriented. The spiral element 57 may have any appropriate width and, like spiral elements 5 and 6, has a leading edge 57*a*, a trailing edge (not shown) equivalent to trailing edges 5*b* and 6*b* of spiral elements 5 and 6, and a product support surface 57*b*. A stack-building area 58 is provided, equivalent to a stack-building area 8 of FIG. 1. In this instance, the stack-building 58 is defined by a pair of side bars 59 and 60 and a second pair of side bars 61 and 62. The side bars 59 and 60, located to either side of spiral element 57, are equivalent to side plate 9 and serve an identical function. Again, side bars 59 and 60 may be tilted slightly to the vertical away from side bars 61 and 62 to minimize the tendency of the stack 63 to topple rearwardly. Such toppling is prevented by side bars 61 and 62, equivalent to side plate 10 of FIG. 1. An infeed device is generally indicated at 64, and can take any form, as described with respect to infeed device 1 of FIG. 1. Again, for purposes of an exemplary showing, an infeed belt is shown at 65, together with a cooperating overhead drive belt 66 with a product 67 shown therebetween. The infeed device 64 directs the products 67 in the direction of arrow H. Again, a plow 68 may be provided, equivalent to plow 11 of FIG. 1 and serving the same purpose. To complete the structure, an outfeed device 13 is shown. Again, the outfeed device may take any form as described above, but, for purposes of an exemplary showing, is illustrated as being a simple outfeed belt moving in the direction of arrow I. Except for the fact that the spiral stacker of FIG. 9 has only one spiral element 57, its operation is otherwise identical to that described with respect to FIGS. 2–5.

In either the embodiment of FIG. 1 or the embodiment of FIG. 9, small adjustments in stack count, which do not involve major changes in stack heights, can be accomplished by appropriate speed changes in the drive. Major changes in stack height, however, require new spiral elements.

Modifications may be made in the invention without departing from the spirit of it.

What is claimed is:

1. A stacker for accumulating generally flat products of substantially the same size and shape into stacks of specific count, said stacker comprising at least one vertically oriented spiral element having a horizontally oriented axis of rotation, said spiral element also having an exterior leading edge, an interior trailing edge and an exterior product supporting surface extending therebetween, a stack-building area, means to rotate said spiral element about its axis of rotation at a predetermined rate with said leading edge, said product support surface and said trailing edge passing through said stack-building area, an infeed device to continuously feed products to said stack-building area, such that as said spiral element rotates therethrough, said products are accumulated in a stack on said product support surface and means to retain said stacked products in said stack-building area until discharged from said product support surface of said spiral element by said trailing edge of said spiral element after each revolution of said spiral element.

2. The stacker claimed in claim 1, including an outfeed device located within said spiral element and extending substantially axially thereof, said outfeed device being positioned to receive said product stacks discharged from said trailing edge of said spiral element and to shift said product stacks out from within said spiral element.

3. The stacker claimed in claim 1, wherein the pitch of said at least one spiral element is equal to the height of a product stack of said specific count plus clearance therefor.

4. The spiral stacker claimed in claim 1, wherein said infeed device is configured to feed new products into said stack-building area at predetermined equal fractional parts of one revolution of said at least one spiral element of a number equal to said specific count.

5. The stacker claimed in claim 1, wherein said infeed device is so configured as to feed each product at substantially the same infeed elevation within said stack-building area, said at least one spiral element being so configured that said product support surface recedes relative to said infeed elevation through said stack-building area at a predetermined rate, whereby said products are accumulated one above the other in stacked form.

6. The stacker claimed in claim 1, wherein said infeed device comprises a conveyor.

7. The stacker claimed in claim 1, wherein said outfeed device comprises a conveyor.

8. The stacker claimed in claim 1, wherein said means to retain said stack of products within said stack-building area comprises at least one plate engaging those edges of said products facing in the direction of rotation of said at least one spiral element.

9. The stacker claimed in claim 1, including at least one plate adjacent those edges of said stacked products facing in a direction opposite the direction of rotation of said at least one spiral element to prevent toppling of said stack in said opposite direction.

10. A stacker for accumulating generally flat products of substantially the same size and shape into stacks of specific count, said stacker comprising two mirror image spiral elements vertically oriented and in parallel spaced relationship with their axes of rotation being coaxial and horizontally oriented, said spiral elements having aligned exterior leading edges and aligned interior trailing edges with product support surfaces extending between said leading and trailing edges, a stack-building area, means to rotate said spiral elements at a predetermined speed and in phase with their leading edges, their product support surfaces and their trailing edges passing through said stack-building area, an infeed device to continuously feed products to said stack-building area such that as said spiral elements rotate therethrough, said products are accumulated in a stack spanning said product support surfaces, and means to retain said stacked products in said stack-building area until discharged from said product support surfaces of said spiral elements by said trailing edges of said spiral elements after each revolution of said spiral elements.

11. The stacker claimed in claim 10, including means to adjust the distance by which said spiral elements are spaced from each other.

12. The stacker claimed in claim 10, including an outfeed device located within said spiral elements and extending substantially axially thereof, said outfeed device being positioned to receive said product stacks discharged from said trailing edges of said spiral elements and to shift said product stacks out from within said spiral elements.

13. The stacker claimed in claim 10, wherein the pitch of said spiral elements is the same and is equal to the height of a product stack of said specific count plus clearance therefor.

14. The stacker claimed in claim 10, wherein said infeed device is configured to feed new products into said stack-building area at predetermined equal fractional parts of one revolution of said spiral elements of a number equal to said specific count.

15. The stacker claimed in claim 10, wherein said infeed device is so configured as to feed each product at substantially the same infeed elevation within said stack-building area, said spiral elements being so configured that their product support surfaces recede relative to said infeed elevation through said stack-building area at a predetermined rate, whereby said products are accumulated one above the other in stacked form.

16. The stacker claimed in claim 10, wherein said infeed device comprises a conveyor.

17. The stacker claimed in claim 10, wherein said outfeed device comprises a conveyor.

18. The stacker claimed in claim 10, wherein said means to retain said stack of products within said stack-building area comprises a plate located between said spiral elements and engaging those edges of said products facing in the direction of rotation of said spiral elements.

19. The stacker claimed in claim 10, including a plate located between said spiral elements and adjacent those edges of said stacked products facing in a direction opposite the direction of rotation of said spiral elements to prevent toppling of said stack in said opposite direction.

20. The stacker claimed in claim 10, including a pair of upright side frames, each of said spiral elements being rotatably supported on one of said side frames, a shaft mounted on said side frames, both of said spiral elements being driven from said shaft by identical timing belts, adjustable means connecting said side frames together whereby to permit adjustment of the distance between said side frames and thus the distance between said spiral elements.

21. A process of accumulating generally flat products of substantially the same size and shape into stacks of specific count comprising the steps of providing at least a first spiral element having an outside leading edge, an inside trailing edge and a product supporting exterior surface extending therebetween, orienting said spiral element vertically and rotating said spiral element about its horizontal axis, providing a stack-building area, causing said leading edge, said product support surface and said trailing edge of said spiral element to pass therethrough once each revolution of said spiral element, continuously feeding products into said stack-building area and maintaining said products within said stack-building area to accumulate a stack thereof on said support surface during a single revolution of said spiral element and discharging said stack from said support surface when said trailing edge passes through said stack-building area.

22. The process claimed in claim 21, including the steps of providing a second mirror image spiral element in parallel spaced relationship to said first spiral element, said second spiral element having an outside leading edge, an inside trailing edge and a product support surface extending therebetween substantially identical to said first spiral element, orienting said second spiral element vertically, coaxially with said first spiral element and in parallel spaced relationship thereto with said leading and trailing edges of said first and second spiral elements aligned, rotating said first and second spiral elements at the same predetermined speed and in phase, causing said leading edges, said product support surfaces and said trailing edges of said first and second spiral elements to pass through said stack-building area simultaneously, causing said products being stacked in said stack-building area to span said spiral element support surfaces, accumulating a stack of products on said support surfaces each revolution of said spiral elements and discharging an accumulated stack from said support surfaces each time the trailing edges of said spiral elements pass through said stack-building area.

23. The process claimed in claim 21, including the step of removing each of said stacks from within said spiral element in a direction substantially axial with respect thereto.

24. The process claimed in claim 21, including the step of configuring said spiral element with a pitch equal to the height of a product stack of said specific count plus clearance therefor.

25. The process claimed in claim 21, including the step of feeding products into said stack-building area at predetermined equal fractional parts of one revolution of said spiral element of a number equal to said specific count.

26. The process claimed in claim 21, including the steps of feeding said products into said stack-building area at substantially the same infeed elevation, and configuring said spiral element such that its product support surface recedes relative to said infeed elevation through said stack-building area at a relatively constant rate, whereby said products are accumulated one above the other in stacked form.

27. The process claimed in claim 22, including the step of adjusting the space between said spiral elements to fit the size of said products.

28. The process claimed in claim 22, including the step of removing each of said stacks from within said spiral elements in a direction substantially axial with respect thereto.

29. The process claimed in claim 22, including the step of configuring said spiral elements with a pitch equal to the height of a product stack of said specific count plus clearance therefor.

30. The process claimed in claim 22, including the step of feeding products into said stack-building area at predetermined equal fractional parts of one revolution of said spiral elements of a number equal to said specific count.

31. The process claimed in claim 22, including the steps of feeding said products into said stack-building area at substantially the same infeed elevation, and configuring said spiral elements such that their product support surfaces recede relative to said infeed elevation through said stack-building area at a predetermined rate, whereby said products are accumulated one above the other in stacked form.

* * * * *

UNITED STATES PATENT AND TRADEMARK OFFICE

CERTIFICATE OF CORRECTION

PATENT NO. : 4,547,113

DATED : October 15, 1985

INVENTOR(S) : David P. Welch and David R. Bennett

It is certified that error appears in the above-identified patent and that said Letters Patent is hereby corrected as shown below:

Column 6, line 58, "27" should read -- 17 --.

Column 6, line 68, "tighened" should read -- tightened --.

Signed and Sealed this

*Eleventh* Day of *March 1986*

[SEAL]

*Attest:*

DONALD J. QUIGG

*Attesting Officer*

*Commissioner of Patents and Trademarks*